US005566668A

United States Patent [19]

Jesadanont

[11] Patent Number: 5,566,668

[45] Date of Patent: Oct. 22, 1996

[54] LIFE-SAVING HELMET

[76] Inventor: Mongkol Jesadanont, Faculty of Pharmaceutical Sciences, Chulalongkorn U. Bkk 10330, Thailand

[21] Appl. No.: 445,031

[22] Filed: May 19, 1995

[51] Int. Cl.[6] ..... A62B 7/02

[52] U.S. Cl. ..... 128/201.26; 128/201.28; 128/205.22; 128/205.25; 128/201.22; 2/424

[58] Field of Search ..... 128/201.22, 201.23, 128/201.24, 201.25, 201.26, 201.28, 204.18, 205.22, 205.25; 2/205, 2.11, 424

[56] References Cited

U.S. PATENT DOCUMENTS

| | | | |
|---|---|---|---|
| 1,150,460 | 8/1915 | Schreiber | 128/201.27 |
| 2,335,475 | 11/1943 | Beall | 128/202.11 |
| 2,897,817 | 8/1959 | Marina | 128/205.25 |
| 2,988,749 | 6/1961 | Crouzet | 2/424 |
| 3,528,414 | 9/1970 | Schueller | 128/202.11 |
| 3,976,063 | 8/1976 | Hennenan et al. | 128/201.25 |
| 4,236,514 | 12/1980 | Moretti | 128/201.23 |
| 4,452,240 | 6/1984 | Moretti | 128/201.23 |
| 4,998,529 | 5/1991 | Werjefelt | 128/201.25 |
| 5,237,707 | 8/1993 | Lowrie | 2/416 |
| 5,245,994 | 9/1993 | Chang et al. | 128/201.25 |
| 5,257,417 | 11/1993 | Oleson | 2/5 |
| 5,309,901 | 5/1994 | Beaussant | 128/201.12 |
| 5,318,018 | 6/1994 | Puma et al. | 128/202.11 |
| 5,355,878 | 10/1994 | Griffiths et al. | 128/206.24 |
| 5,429,125 | 7/1995 | Wagner et al. | 128/204.18 |

FOREIGN PATENT DOCUMENTS

| | | | |
|---|---|---|---|
| 746839 | 3/1933 | France | 128/201.26 |

*Primary Examiner*—V. Millin
*Assistant Examiner*—William J. Deane, Jr.

[57] ABSTRACT

A life-saving helmet for escaping from the fire comprised of a transparent plastic bowl. There is a mouth-piece tubing for user putting in his mouth to blow out the exhaled air, while the external end has a check valve allowing only the one-way flow of the air outside. There is another tubing slight above the user's nose, having an automatic check valve allowing the one-way flow of the air to the outside, thereby keeping the pressure inside the helmet constant at one atmospheric pressure. A spot-light at the forehead level of the helmet provides light to assist escaping in the dark and as a signal seeking for help. A built-in plastic pipe on top of the helmet contains a breathable air bottle. The bottle has a tubing extended out. The tip of the tubing abuts the upper edge of a rectangular groove at inner anterior wall of the plastic pipe. A sheath is sealed at lower edge of the blow with an elastic band at its rim. The posterior end of plastic pipe is closed with a lid. At the center of the lid is a hole with the internal threads mating with the external threads of a round-headed bolt. The bolt is turned until its end pushes the bottle to move a predetermined distance and causes the release of the gas. The breathable gas passes through the groove to fill in the helmet. A waterproof adhesive tape is used to prevent the leakage of water into the helmet.

4 Claims, 5 Drawing Sheets

LIFE-SAVING HELMET

BACKGROUND OF THE INVENTION

In case of fire in the buildings and many other places such as cruisers or airplanes, most of the time a large number of victims became unconscious because of the smoke and therefore being burned to death. In fact, the smoke or the poisonous gas built up by the burning are the true causes of those large number of deaths in the fire. Fire-fighting authorities always suggest using a plastic bag or wetted cloth to cover one's head before finding his way out of the fire. However, such practice is quite ineffective and can not help allowing a long enough time for escaping from the fire. It is the objective of this invention to provide a helping means for a person trying to escape from the fire by preventing him from breathing in the smoke or any noxious gas for a considerably long time.

SUMMARY OF THE INVENTION

A life-saving helmet used by a person to allow enough time for escaping from a fire comprised of a transparent plastic bowl. The helmet is large enough to cover the whole head of the wearer. There is a tubing at the front of the helmet for the user to exhale by his mouth, while the other end of the tubing outside the helmet has a check valve allowing only the one-way flow of the exhaled air to the outside of the helmet. There is another tubing at the level slight above the nose of the wearer, having an automatic check valve at the outer end allowing the one-way flow of the air to the outside of the helmet only when the pressure inside the helmet is greater than one atmospheric pressure. Thus, the pressure inside the helmet is kept constant at one atmospheric pressure all the time the helmet being used. A spot-light at the forehead level of the helmet provides light to assist the escaping in the dark in case of fire and as a signal seeking for help to notify the rescue groups. A built-in plastic pipe with anterior closed end on top of the helmet contains a breathable air bottle. The bottle has a short hard plastic tubing extended out at the top. The tip of the short plastic tubing abuts the upper edges of a rectangular groove at the inner anterior wall of the plastic pipe. The groove has its width equal to the inner diameter of the short plastic tubing while its length is a little greater than the outer diameter of the tubing. This allows the gas released from the bottle to flow out into the interior of the helmet through the groove and a passage connecting between an anterior space of the plastic pipe and the interior of the helmet. A soft cover sheath is sealed all the way along the lowest edge of the helmet and having an elastic band at its lower rim to fit tightly with the user's neck for preventing of the smoke from entering the helmet and the air inside the helmet not to flow out. The posterior end of the plastic pipe is an opened end with the internal threads to mate tightly with the external threads of a lid. At the center of the lid is a hole with the internal threads mating tightly with the external threads of a round-headed bolt. The bolt is turned until its round head reaches the lid so that its end pushes the bottom of the bottle to move the bottle a predetermined distance and causes the release of the gas. The breathable gas passes out through the groove to fill inside the helmet. The helmet user thus has a longer time being conscious during the escaping from a fire.

A waterproof adhesive tape can be used to attach around both the elastic band and the user's neck to prevent the leakage of water into the helmet in case of using this helmet for diving.

DETAILED DESCRIPTION OF PREFERRED EMBODIMENTS

Figure 1:
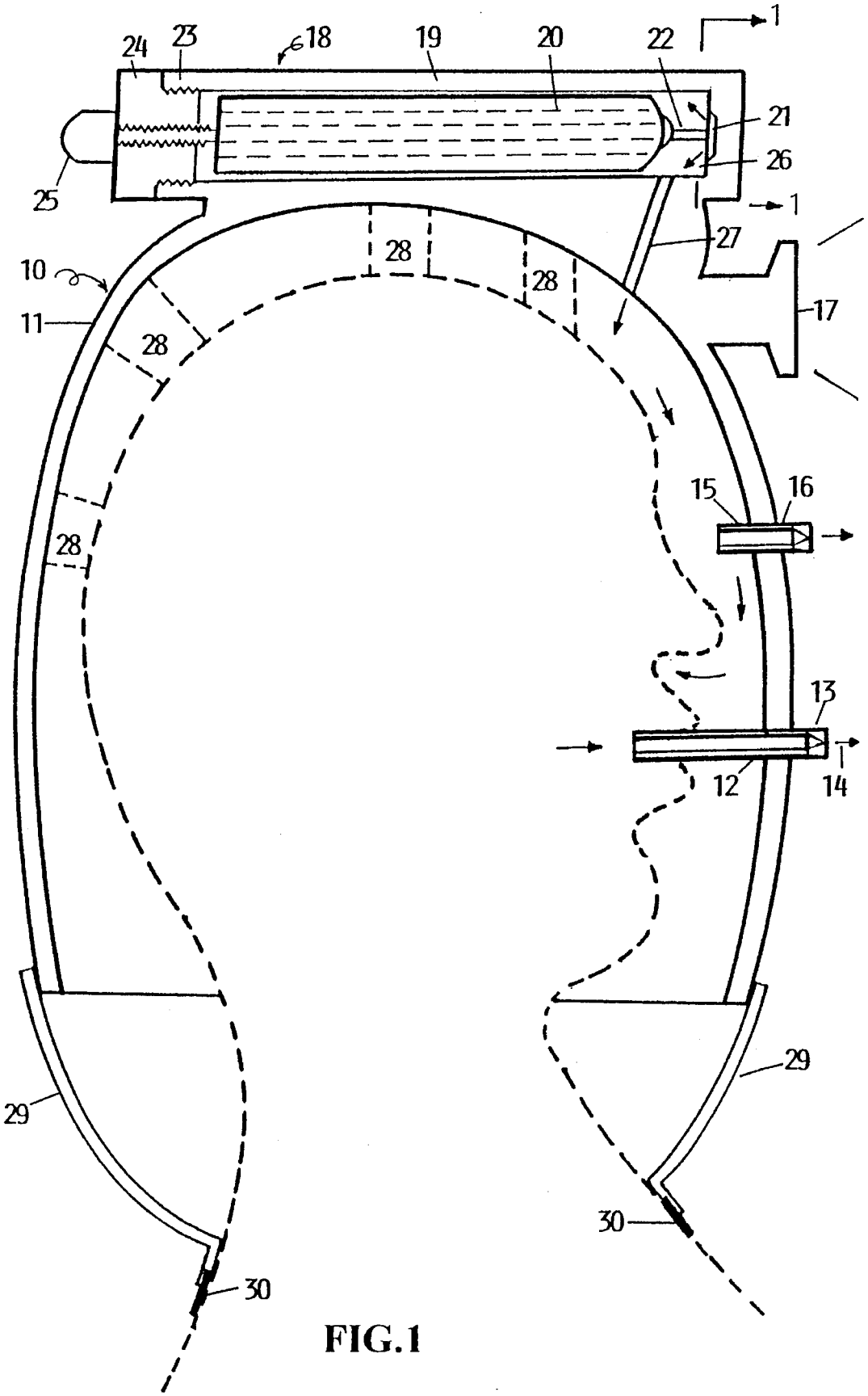
FIG. 1 shows all the components of a life-saving helmet of the present invention.

FIG. 1 shows a life-saving helmet 10 of the present invention comprised of a transparent hard plastic bowl 11 or transparent materials made of the fire-resistant type. At the anterior part of the helmet at the level of the helmet-wearer's mouth, there is a mouth-piece tubing 12. A helmet user put the inner end of tubing 12 in his mouth and exhales carbon dioxide by his mouth through a check valve 13 at the outer end of the tubing 12 as shown by arrow 14. A check valve is a valve permitting liquids or gases to flow in one direction only. This check valve 13 allows the exhaled air to pass out only in one direction, i.e. to the outside of the helmet; while the smoke, the polluted air or the poisonous gas from the outside are prevented from entering the helmet and therefore protects the helmet-user from being intoxicated or suffocated.

Above the tubing 12 is another tubing 15 at the level slight above the user's nose for regulating the pressure inside the helmet. The outer end of this tubing 15 is an automatic check valve 16 to control the pressure inside the plastic helmet. It functions by automatically allowing any excess amount of air to flow only in one direction from the inside to the outside of the helmet when the pressure within the helmet is greater than one atmospheric pressure (14.75 lbs./sq. in.), and to prevent the air or the smoke or the poisonous gas from entering from the exterior of the helmet. Therefore, the pressure inside the helmet is kept constant at one atmospheric pressure at all time during the usage of the helmet. The helmet wearer can then breathe in normally through his nose and breath out through his mouth and exhales the air out through the check valve 13.

Above the tubing 15, at the level of user's forehead is a spot-light or any light source 17 powered by batteries.

Right on the top of the transparent plastic bowl 11 is a built-in plastic pipe set 18. There can be 1–3 of this plastic pipe set depending on the purpose of the using of the helmet. The main purpose in inventing this helmet is to make it possible for a person to escape from fire in any buildings, while it can also be used for very many other purposes such as to be used by the traffic controllers or road construction workers who have to work for a considerably long time in those area polluted with carbon monoxide and noxious gas built up in a traffic congested area. It may also be used by those who work or have to be in the mines, underground railway stations, deep holes or sewage drain pipes; very tall mountain-climber; those whose duty are to handle the poisons or any dangerous gases exploded in public accidentally or criminally; those who work in the factories in the harmful or polluted environment and those who dive. Furthermore, this invention can be readily used for first aid purpose to provide oxygen to the suffocated victims since it is very easy to use and carry due to its very light weight (not more than 1 Kg).

The plastic pipe set 18 comprises of a hard plastic pipe 19 each contains a gas bottle 20 inside. The gas bottle 20 has all the features and mechanisms for releasing of its contents the same as those of a conventional spray bottle. The gas contained inside this bottle 20 can be oxygen or any breathable gases. The gas pressure inside the bottle is around 30 lbs./sq. in. or approximately 2 atmospheric pressure.

Figure 2:
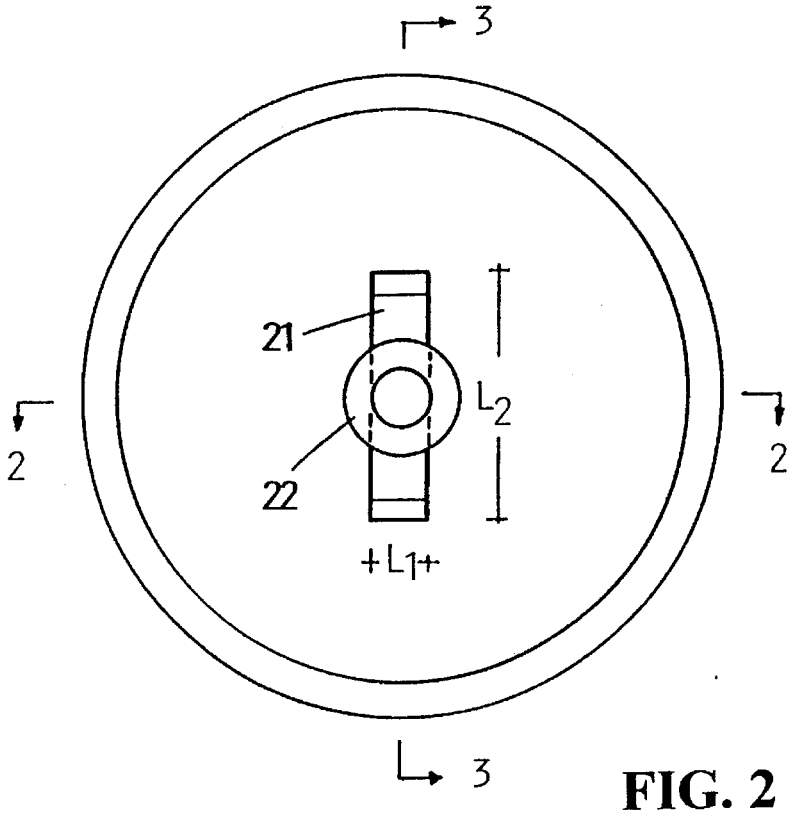
FIG. 2 is a cross-sectional view along the line 1—1 of FIG. 1 showing how the tip of a plastic tubing of a pressurized oxygen bottle is pressed against the upper edge of the groove at the inner front wall of a plastic pipe, wherethrough the gas released from the oxygen bottle passes out.

The inner wall of this hard plastic pipe 19 at the anterior end has a groove 21 having its width $L_1$ (FIGS. 2 and 3) equal to the inner diameter of a short hard plastic tubing 22 of the gas bottle 20. This short hard plastic tubing 22 is in communication with the gas inside the bottle.

Figure 3:
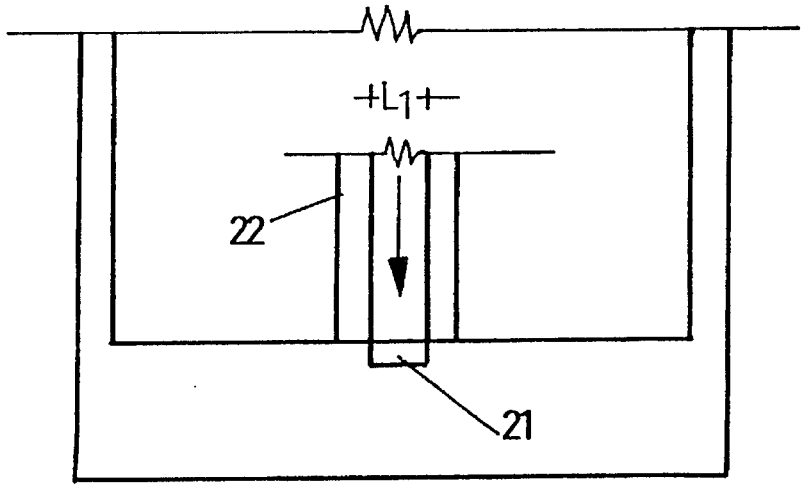
FIG. 3 is a sectional view along the line 2—2 of FIG. 2 showing how the tip of a plastic tubing of a pressurized oxygen bottle is pressed against the edge of the groove at the inner front wall of the plastic pipe.

Tubing 22 abuts on the upper edge of the groove 21 (FIG. 3). The length $L_2$ of the groove is longer than the outer diameter of the short plastic tubing 22. When the gas bottle is pushed forward, the tip of the short plastic tubing 22 remains stationary though pressed against the upper edge of the groove 21, a portion of tubing 22 then moves relatively inside the gas bottle and causes the conventional mechanisms at the inner end of the tubing 22 inside the gas bottle 20 to release the gas contained under pressure in the bottle outside through the tubing 22 and the groove 21.

The other end of the plastic pipe 19 is an opened end 23 having internal threads which mate tightly with the external threads of lid 24.

At the center of the lid 24 there is a hole with the internal threads all through which can mate tightly with the external threads of a round-headed bolt 25.

Space 26 is a space between the anterior end of the gas bottle 20 and the inner wall of plastic pipe 19. Connecting between space 26 and the interior of helmet 10 is a passage 27.

At the inside surface of the helmet 10 are several pieces of soft lining materials 28 which can be either plastic foams or any kind of appropriate lining materials.

There is a fire-resistant soft sheath 29 attached and sealed all around tightly to the lowest edge of the transparent plastic bowl 11 to prevent leakage of fluids (air, smoke and water). At the lowest rim of the sheath 29 is attached firmly all around with an elastic band 30 capable of being stretched out together to be worn on the user's head and when deforms can fit tightly to the user's neck to prevent leakage of fluids.

While not being used, the round-headed bolt 25 should be released until its tip does not push the bottom of the gas bottle 20 such that no gas is released.

Modification can also be made such that the mouth-piece portion of tubing 12 inside the helmet may be of the disposable type for hygienic reason. The check valves at both outlets can alternatively be any kinds of mechanisms, for example, diaphragm; that can serve the same function as permitting only the one way flowing of the air through and in the case of the automatic one—would work only when the pressure inside the helmet is greater than a predetermined level.

In case of fire, the user put this life-saving helmet 10 on his head by extending the lower rim of soft sheath 29 together with the elastic band 30. The elastic band 30 then deforms to fit tightly with his neck. He then puts the tubing 12 in his mouth.

Figure 4:
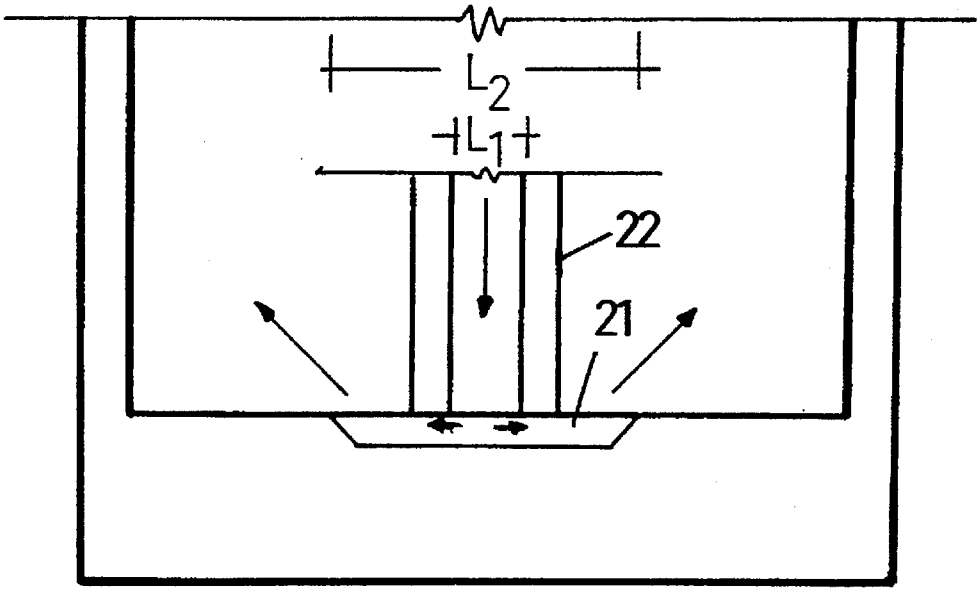
FIG. 4 is a sectional view along the line 3—3 of FIG. 2 showing how the gas released from a pressurized oxygen bottle passes out shown by the direction of arrows, from a plastic tubing through the groove at the inner front wall of the plastic pipe.

The user turns the bolt 25 inwardly until its round head reaches the posterior outer surface of the lid 24, in this manner the bottom of the gas bottle 20 is then pushed by the inner end of the round-headed bolt 25 for a predetermined distance and moved towards tubing 22 which is stationary abuting the upper edges of the groove 21 at the same distance. The tubing 22 then actuates the mechanisms inside the gas bottle 20 to release gas out at a constant predetermined rate optimal for breathing at all time while the gas bottle 20 is being pushed. The released gas passes out through the groove 21 as shown by the arrows in FIGS. 1 and 4, and flows into the helmet through the space 26 (FIG. 1) and the passage 27 which connects between space 26 and the interior of the plastic helmet 10 so that the helmet user can breathe in through his nose and breathe out by his mouth out through tubing 12 and the check valve 13 in the direction of arrow 14 to the outside of the life-saving helmet of the present invention. This helps that the exhaled air may not deposit within the helmet 10. This presents an effective way to prevent the helmet user from suffocating with smoke for at least a long enough time to find his way out the fire or until the rescue groups come and help him out. The spot-light 17 would help him finding his way out in the dark or be used as a signal to help the rescue groups finding him.

Figure 5:
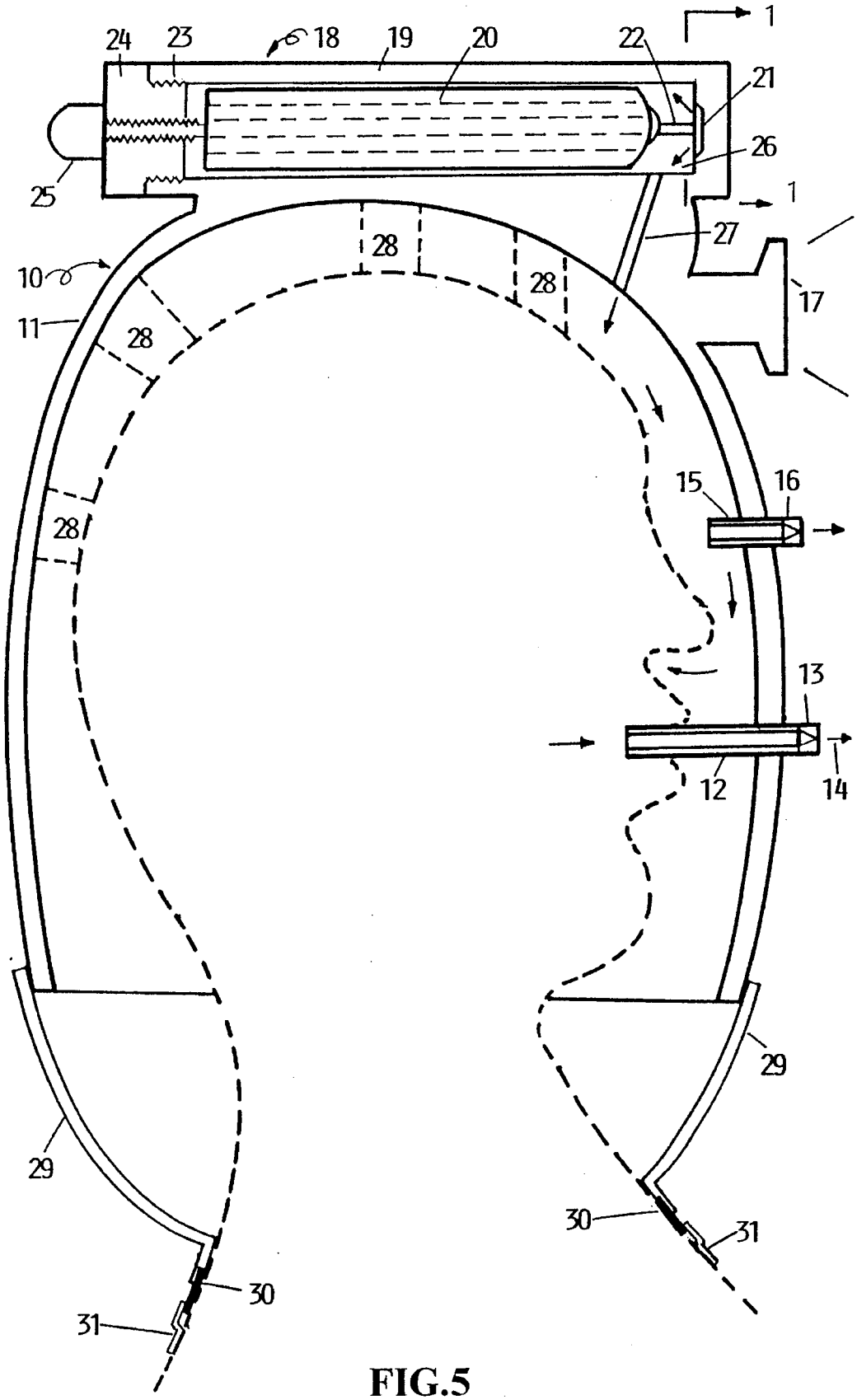
FIG. 5 shows a waterproof adhesive tape attached both around the elastic band and the user's neck to prevent the leakage of water into the helmet.

When this life-saving helmet is used for diving, to make sure that water can not leak into the helmet a waterproof adhesive tape 31 is used to attach around both the elastic band 30 and the user's neck as in FIG. 5 to prolong the diving time.

Figure 6:
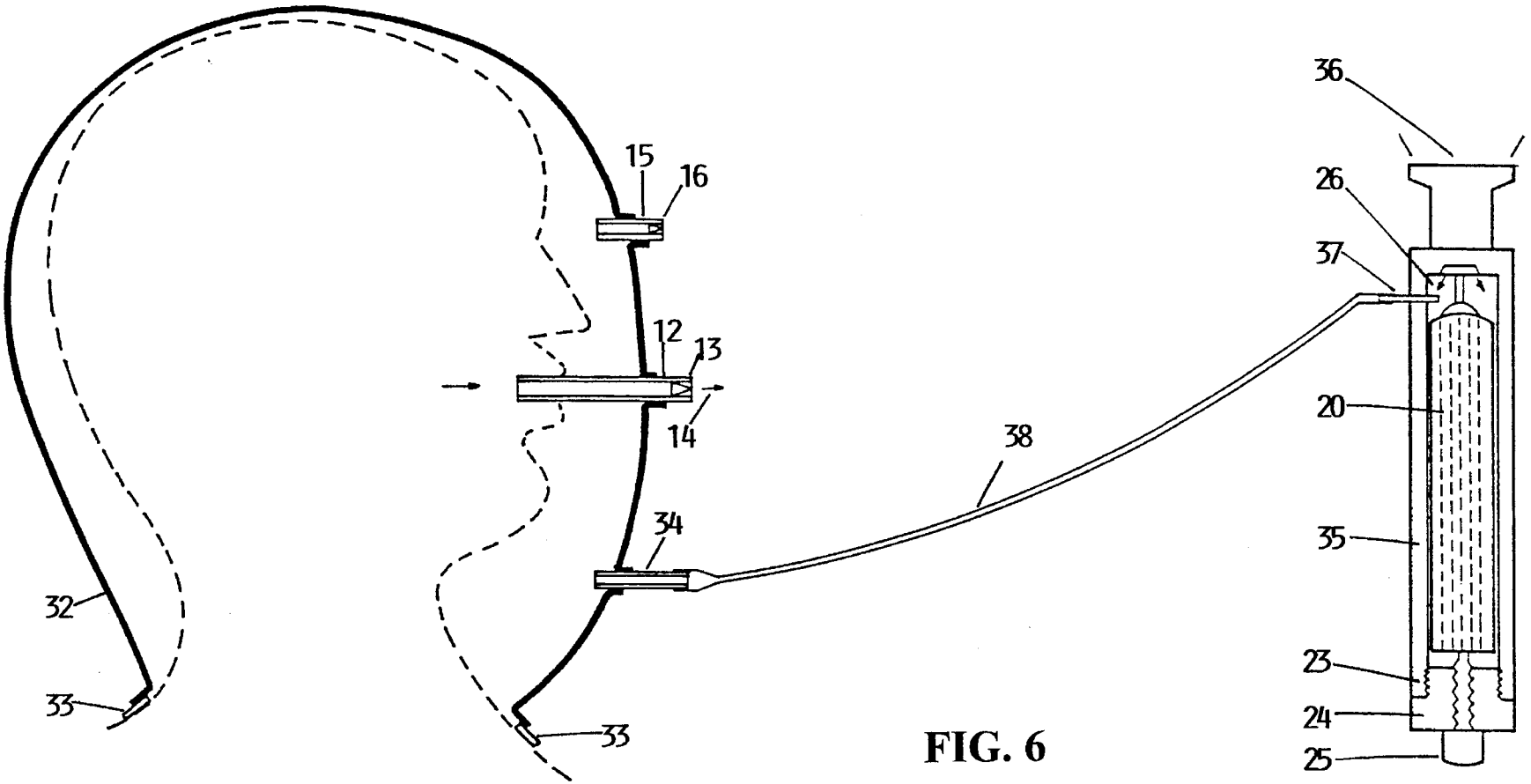
FIG. 6 shows a life-saving helmet of plastic bag type.

As shown in FIG. 6, a different modification can be made where a transparent plastic bag 32 which can cover the whole head of the user with an elastic band 33 attached at its lowest edge is used instead of the transparent hard plastic bowl 11. This elastic band 33 when deformed can fit tightly around the user's neck. The transparent plastic bag 32 is of the same size and most of its components are similar to the transparent plastic bowl 11, comprised of a mouth-piece tubing 12 with a check-valve 13, a pressure-regulating tubing 15 with an automatic check-valve 16, and a tubing 34.

A separate plastic pipe set 35 with a built-in spot-light 36 at the anterior end containing a breathable air bottle 20 inside is carried by the user's hand during the usage in case of fire. A short hard tubing 37 is extended out from space 26. A long flexible plastic tubing 38 carries gas or breathable air from the space 26 through the short hard tubing 37 to the inside of the transparent soft plastic bag 32 through tubing 34.

In case of fire, the method of using this transparent plastic bag helmet is the same as that described for the transparent hard plastic bowl helmet.

It should be appreciated by those skilled in the art that the specific embodiments disclosed above may be readily utilized as a basis for modifying or designing other structures for carrying out the same purposes of the present invention. It should also be realized by those skilled in the art that such equivalent constructions do not depart from the spirit and scope of the invention as set forth in the appended claims.

I claim:

1. A life-saving helmet set for fire-escaping purpose, comprising:

a) a transparent hard plastic bowl, made of transparent hard plastic, large enough to cover the whole head of a wearer having a cover sheath at its lower end with an elastic band attached at its lower rim to fit around the neck of said wearer with or without a waterproof adhesive tape applied around between said elastic band and said wearer's neck to prevent leakage of fluid into said helmet;

b) a mouth-piece tubing, positioned relatively at the level of said wearer's mouth having one end inside said helmet such that said wearer can keep this inner end in his mouth for blowing out the exhaled air during the use of said helmet, and another end outside said helmet with a check valve at the outermost end to allow the flowing of the exhaled air only in one direction, from inside to outside of said helmet;

c) a pressure-regulating tubing, positioned relatively at the level slight above said wearer's nose having one end inside and another end outside said helmet with an automatic check valve at the outermost end to allow the flowing of the air only in one direction, from inside to outside of said helmet only when the pressure within said helmet is greater than one atmospheric pressure;

d) a light source, which is a spot-light located relatively at the anterior of said transparent hard plastic bowl at the level of said wearer's forehead;

e) a plastic pipe set, which is a hard plastic pipe containing a pressurized breathable-gas bottle inside, built-in at the top of said transparent hard plastic bowl, having a groove at the anterior inner surface to allow breathable gas if released to flow out into an anterior space between the anterior inner wall of said plastic pipe and said gas bottle, and an opened posterior end with several turns of internal threads which mate tightly with the external threaded end of a lid;

f) a passage connecting between said anterior space of said plastic pipe set and the interior of said transparent hard plastic bowl to allow the released breathable gas to flow into the interior of said helmet to support breathing of said wearer; and g) several pieces of soft lining material fixed to the inside surface of said hard transparent plastic bowl.

2. A life-saving helmet set for fire-escaping purpose of claim 1, wherein said lid which mates tightly with the internal threads at said posterior end of said hard plastic pipe has a hole at its center with internal threads all the way through to mate tightly with external threads of a round-headed bolt which upon turning inwardly until its round head reaches said lid, its inner end pushes said gas bottle contained in said hard plastic pipe to move forward for a predetermined short distance and causes relative movement of a stationary short hard plastic tubing communicating outside with the gas inside said gas bottle, and thereby causes a gas releasing mechanisms at the inner end of said short hard tubing to release gas out at a predetermined rate optimal for assisting the breathing of said wearer.

3. A life-saving helmet set for fire-escaping purpose of claim 1, wherein said groove at the anterior inner wall of said hard plastic pipe has its width equal to the inner diameter of said stationary short hard plastic tubing of said gas bottle and its length greater than the outer diameter of said tubing.

4. A life-saving helmet set for fire-escaping purpose alternatively comprising:

a) a transparent soft plastic bag large enough to cover the whole head of the wearer with an elastic ban at its lowest edge with or without a waterproof adhesive tape applied around between said elastic band and said wearer's neck to prevent leakage of fluid into said helmet;

b) a mouth-piece tubing, positioned relatively at the level of said wearer's mouth having one end inside said bag such that said wearer can keep this inner end in his mouth for blowing out the exhaled air during the use of said set, and another end outside said bag with a check valve at the outermost end to allow the flowing of the exhaled air only in one direction, from inside to outside of said bag;

c) a pressure-regulating tubing, positioned relatively at the level slight above said wearer's nose having one end inside and another end outside said bag with an automatic check valve at the outermost end to allow the flowing of the air only in one direction, from inside to outside of said bag only when the pressure within said bag is greater than one atmospheric pressure;

d) a plastic pipe set with a built-in spot-light at its anterior end, which is a hard plastic pipe containing a pressurized breathable-gas bottle inside, having a groove at the anterior inner surface having its width equal to the inner diameter of a stationary short hard plastic tubing communicating outside with the gas inside said gas bottle and its length greater than the outer diameter of said tubing, to allow breathable gas if released to flow out through said short hard plastic tubing into an anterior space between the anterior inner wall of said plastic pipe and said gas bottle, and an opened posterior end with several turns of internal threads which mate tightly with the external threaded end of a lid, which has a hole at its center with internal threads all the way through to mate tightly with the external threads of a round-headed bolt, whereupon turning of said bolt inwardly until its round head reaches said lid, its inner end pushes said pressurized gas bottle to move forward a predetermined short distance and causes relative movement of said stationary short hard plastic tubing, thereby causes a gas releasing mechanisms at the inner end of said short hard tubing to release gas out at a predetermined rate optimal for assisting the breathing of said wearer;

f) a gas passage, which is a long flexible plastic tubing connecting between said anterior space of said plastic pipe set and the interior of said transparent soft plastic bag at a position relatively below said wearer's chin to allow the released breathable gas to flow into the interior of said bag to support breathing of said wearer.

* * * * *